US009776054B2

(12) United States Patent
Horacek et al.

(10) Patent No.: US 9,776,054 B2
(45) **Date of Patent: *Oct. 3, 2017**

(54) STRUCTURAL RESPONSE MODIFYING FEATURES OF A GOLF CLUB HEAD

(71) Applicant: SRI Sports Limited, Kobe-shi (JP)

(72) Inventors: Robert J. Horacek, Hermosa Beach, CA (US); John J. Rae, Westminster, CA (US); Nathaniel J. Radcliffe, Huntington Beach, CA (US); Clark Radcliffe, Okemos, MI (US)

(73) Assignee: Dunlop Sports Co., Ltd., Kobe (JP)

( * ) Notice: Subject to any disclaimer, the term of this patent is extended or adjusted under 35 U.S.C. 154(b) by 273 days.

This patent is subject to a terminal disclaimer.

(21) Appl. No.: 14/473,499

(22) Filed: Aug. 29, 2014

(65) Prior Publication Data

US 2015/0057102 A1 Feb. 26, 2015

Related U.S. Application Data

(63) Continuation of application No. 13/731,898, filed on Dec. 31, 2012, now Pat. No. 8,827,834, which is a (Continued)

(51) Int. Cl.

| | |
|---|---|
| ***A63B 53/04*** | (2015.01) |
| *A63B 71/06* | (2006.01) |
| *A63B 60/00* | (2015.01) |

(52) U.S. Cl.

CPC ..... *A63B 53/0466* (2013.01); *A63B 53/04* (2013.01); *A63B 2053/0408* (2013.01); (Continued)

(58) Field of Classification Search

USPC ..... 473/324–350

See application file for complete search history.

(56) References Cited

U.S. PATENT DOCUMENTS

| | | | |
|---|---|---|---|
| 5,346,217 | A | 9/1994 | Tsuchiya et al. |
| 5,935,020 | A | 8/1999 | Stites et al. |

(Continued)

FOREIGN PATENT DOCUMENTS

| | | |
|---|---|---|
| JP | 10-033723 | 2/1998 |
| JP | 11-19253 A | 1/1999 |

(Continued)

OTHER PUBLICATIONS

Golf Works (Maltby), The Golf Club Identification & Price Guide IV 1950-1998 (© 1999), p. 32-2.

(Continued)

*Primary Examiner* — Alvin Hunter

(74) *Attorney, Agent, or Firm* — Steptoe & Johnson LLP

(57) ABSTRACT

A hollow golf club head having face end and tail ends, a strike face at the face end, a crown, a sole, and a structural response modifying constraining member having first and second ends, the second being forward of the first and spaced from the strike face, the constraining member extending vertically and in contact with the sole and the crown at its first and second ends, and extending horizontally distance that is substantially less than the sole length, when the club head is in address position.

34 Claims, 15 Drawing Sheets

Related U.S. Application Data continuation of application No. 12/923,595, filed on Sep. 29, 2010, now Pat. No. 8,357,056, which is a continuation of application No. 11/705,499, filed on Feb. 13, 2007, now Pat. No. 7,854,666.

(60) Provisional application No. 60/772,881, filed on Feb. 14, 2006.

(52) U.S. Cl.
CPC ..... *A63B 2053/0412* (2013.01); *A63B 2053/0433* (2013.01); *A63B 2053/0437* (2013.01); *A63B 2053/0491* (2013.01); *A63B 2060/002* (2015.10); *A63B 2071/0633* (2013.01)

(56) References Cited

U.S. PATENT DOCUMENTS

| | | | | |
|---|---|---|---|---|
| 6,428,426 | B1 | 8/2002 | Helmstetter et al. | |
| 6,991,558 | B2 | 1/2006 | Beach et al. | |
| 7,160,205 | B2 | 1/2007 | Yamamoto | |
| 7,316,624 | B2 | 1/2008 | Sanchez | |
| 7,470,200 | B2 | 12/2008 | Sanchez | |
| 7,854,666 | B2 | 12/2010 | Horacek et al. | |
| 8,357,056 | B2 | 1/2013 | Horacek et al. | |
| 8,827,834 | B2 * | 9/2014 | Horacek ..... | A63B 53/0466 473/332 |
| 2005/0221913 | A1 | 10/2005 | Kusumoto | |

FOREIGN PATENT DOCUMENTS

| | | |
|---|---|---|
| JP | 2000-317018 | 11/2000 |
| JP | 2002-186691 | 7/2002 |

OTHER PUBLICATIONS

Photographs of internal structure of Nicklaus Air Bear 2 Clubhead (1997-1998).

* cited by examiner

STRUCTURAL RESPONSE MODIFYING FEATURES OF A GOLF CLUB HEAD

CROSS REFERENCE TO RELATED APPLICATIONS

This application is a continuation of application Ser. No. 13/733,898, filed Dec. 31, 2012, which is a continuation of application Ser. No. 12/923,595, filed Sep. 29, 2010, which is a continuation of application Ser. No. 11/705,499, filed Feb. 13, now U.S. Pat. No. 7,854,666, which is a continuation-in-part of application Ser. No. 11/247,148 filed Oct. 12, 2005, now U.S. Pat. No. 7,651,414, which claims the benefits under 35 U.S.C. §119(e) of Provisional Application No. 60/617,659, filed Oct. 13, 2004 and Provisional Application No. 60/665,653, filed Mar. 25, 2005. This application also claims the benefits under 35 U.S.C. §119(e) of Provisional Application No. 60/772,881, filed Feb. 14, 2006. The entire contents of each of these prior applications are expressly incorporated herein by reference thereto.

BACKGROUND

This invention pertains generally to improved metal wood type golf club heads. A recent trend in golf club head design has been to increase the size of such heads to generate increased performance and create more "forgiving" golf clubs. Although this can be said to be true for golf clubs in general, it may be observed that wood type club heads in particular have increased in size dramatically over the past few years. This has presented a number of challenges in particular to designers of modern golf clubs of the "metal wood" variety, a detailed discussion of which is contained in the above referenced applications.

SUMMARY

A metalwood head configuration that provides substantial advancements in performance, is proposed. The sound at impact of exemplary club heads in accordance with the teachings of the various embodiments of the present invention is deemed improved and more appealing in comparison to many performance wood-type clubs produced recently. In particular, a metallic ringing sound produced at impact, while different from that produced by conventional oversized metalwoods, is confidence inspiring to golfers and equates to an overall impression of quality and performance. The sound produced at impact by a golf club head is related to the structural response of the head. Hollow metal wood club heads having modified structural geometries that improve performance may exhibit structural responses that result in poor acoustical performance.

Therefore, structures are disclosed for improving the acoustical response of a hollow metalwood golf club heads having performance driven modifications to their head shape. These and other features, aspects, and advantages of the club head according to the invention in its various embodiments will become apparent after consideration of the ensuing description and the accompanying drawings.

BRIEF DESCRIPTION OF THE DRAWINGS

Embodiments of the present invention will now be described, by way of example only, with reference to the following drawings in which:

FIG. 10(*b*) is a cross-sectional view of the golf club head of FIG. 7 taken along line XII(B)-XII(B) showing a second embodiment of an internal feature of the golf club head according to the invention.

FIG. 10(*c*) is a cross-sectional view of the golf club head of FIG. 7 taken along line XII(B)-XII(B) showing a third embodiment of an internal feature of the golf club head according to the invention.

FIG. 10(*d*) is a cross-sectional view of the golf club head of FIG. 7 taken along line XII(B)-XII(B) showing a fourth embodiment of an internal feature of the golf club head according to the invention.

FIG. 10(*e*) is a cross-sectional view of the golf club head of FIG. 7 taken along line XII(B)-XII(B) showing a fifth embodiment of an internal feature of the golf club head according to the invention.

FIG. 10(*f*) is a cross-sectional view of the golf club head of FIG. 7 taken along line XII(B)-XII(B) showing a sixth embodiment of an internal feature of the golf club head according to the invention.

FIG. 10(*g*) is a cross-sectional view of the golf club head of FIG. 7 taken along line XII(B)-XII(B) showing a seventh embodiment of an internal feature of the golf club head according to the invention.

FIG. 10(*h*) is a cross-sectional view of the golf club head of FIG. 7 taken along line XII(B)-XII(B) showing an eighth embodiment of an internal feature of the golf club head according to the invention.

FIG. 12(*b*) is a cross-sectional view of the golf club head of FIG. 11 taken along line XIII(b)-XIII(b).

FIG. 14(*b*) is cross-sectional view of the golf club head of FIG. 13 showing a second embodiment of an internal feature of the golf club head according to the invention.

FIG. 14(*c*) is cross-sectional view of the golf club head of FIG. 13 showing a third embodiment of an internal feature of the golf club head according to the invention.

FIG. 14(*d*) is cross-sectional view of the golf club head of FIG. 13 showing a fourth embodiment of an internal feature of the golf club head according to the invention.

FIG. 14(*e*) is cross-sectional view of the golf club head of FIG. 13 showing a fifth embodiment of an internal feature of the golf club head according to the invention.

FIG. 14(*f*) is cross-sectional view of the golf club head of FIG. 13 showing a sixth embodiment of an internal feature of the golf club head according to the invention.

FIG. 14(*g*) is cross-sectional view of the golf club head of FIG. 13 showing a seventh embodiment of an internal feature of the golf club head according to the invention.

FIG. 14(*h*) is cross-sectional view of the golf club head of FIG. 13 showing an eighth embodiment of an internal feature of the golf club head according to the invention.

FIG. 15(*a*) is a cross-sectional view of the golf club head of FIG. 15 showing an internal feature of the golf club head according to the invention.

FIG. 15(*b*) is a cross-sectional view of the golf club head of FIG. 15 showing a second embodiment of internal feature of the golf club head according to the invention.

For the purposes of illustration these figures are not necessarily drawn to scale. In all of the figures, like components may be designated by like reference numerals.

DETAILED DESCRIPTION

Figure 1:
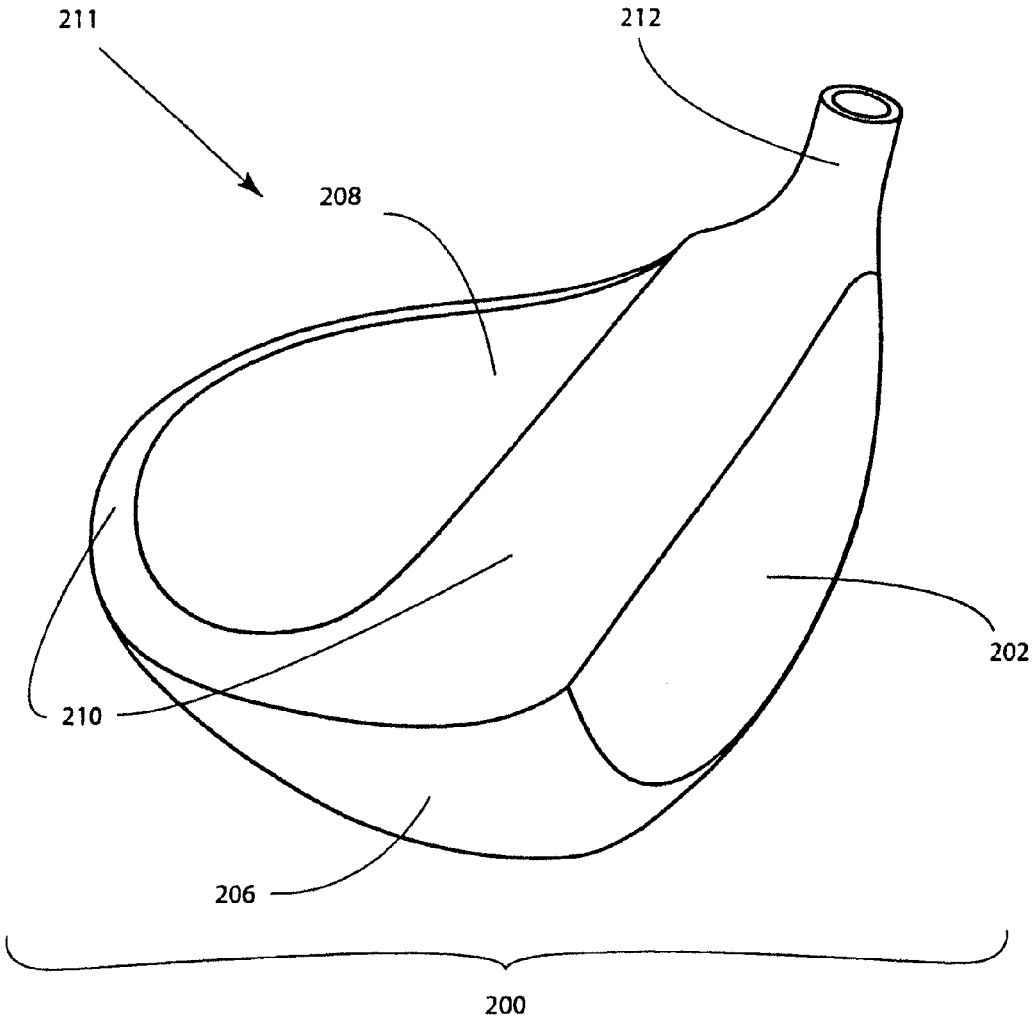
FIG. 1 is a perspective view of an embodiment of a club head in accordance with the present invention.
Figure 3:
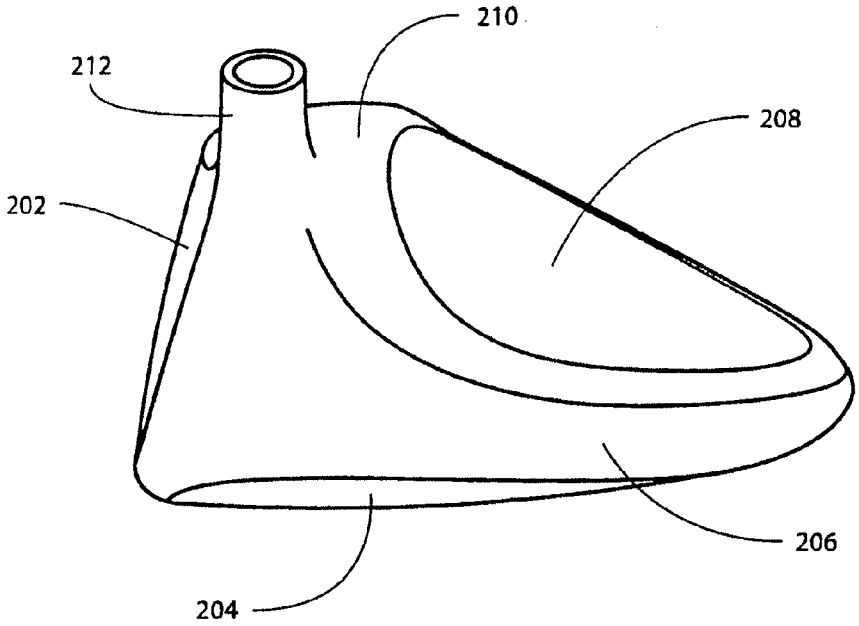
FIG. 3 is a heel view of the club head of FIG. 1.
Figure 4:
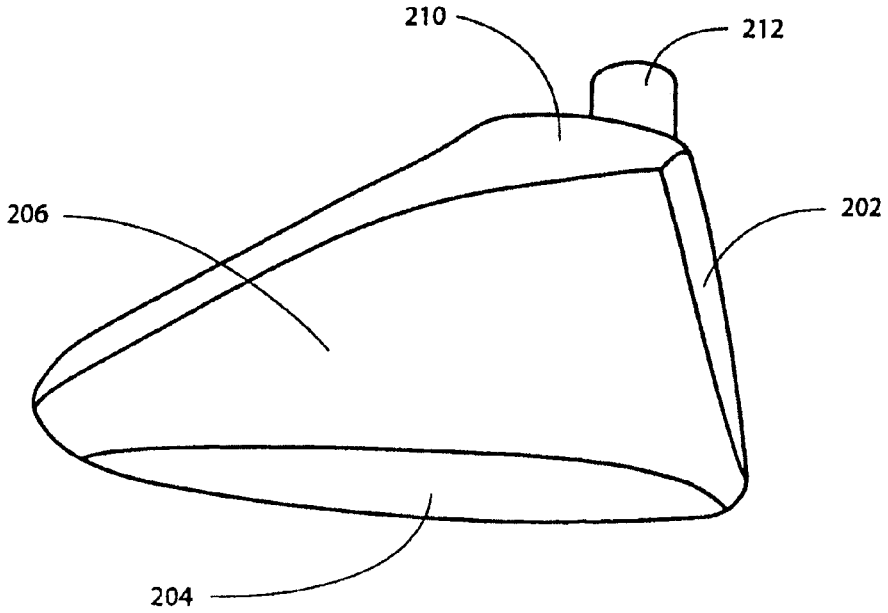
FIG. 4 is a toe view of the club head of FIG. 1.

A club head 200 is shown in FIG. 1 depicting an exemplary embodiment of the present invention. The head has five primary surfaces, each defining a portion of the club head 200, namely, a front surface defining a striking face portion 202, a bottom surface defining a sole portion 204 (visible in FIGS. 3 and 4), a side surface defining a skirt portion 206, a first top surface defining a major crown portion 208, and a second top surface defining a minor crown portion 210. Major crown portion 208 and minor crown portion 210 together form a crown 211. A hosel 212 may be provided for receiving a shaft (not shown) to which head 200 may be attached. Alternatively, head 200 may have a "hoseless" configuration well known in the art.

Figure 2:
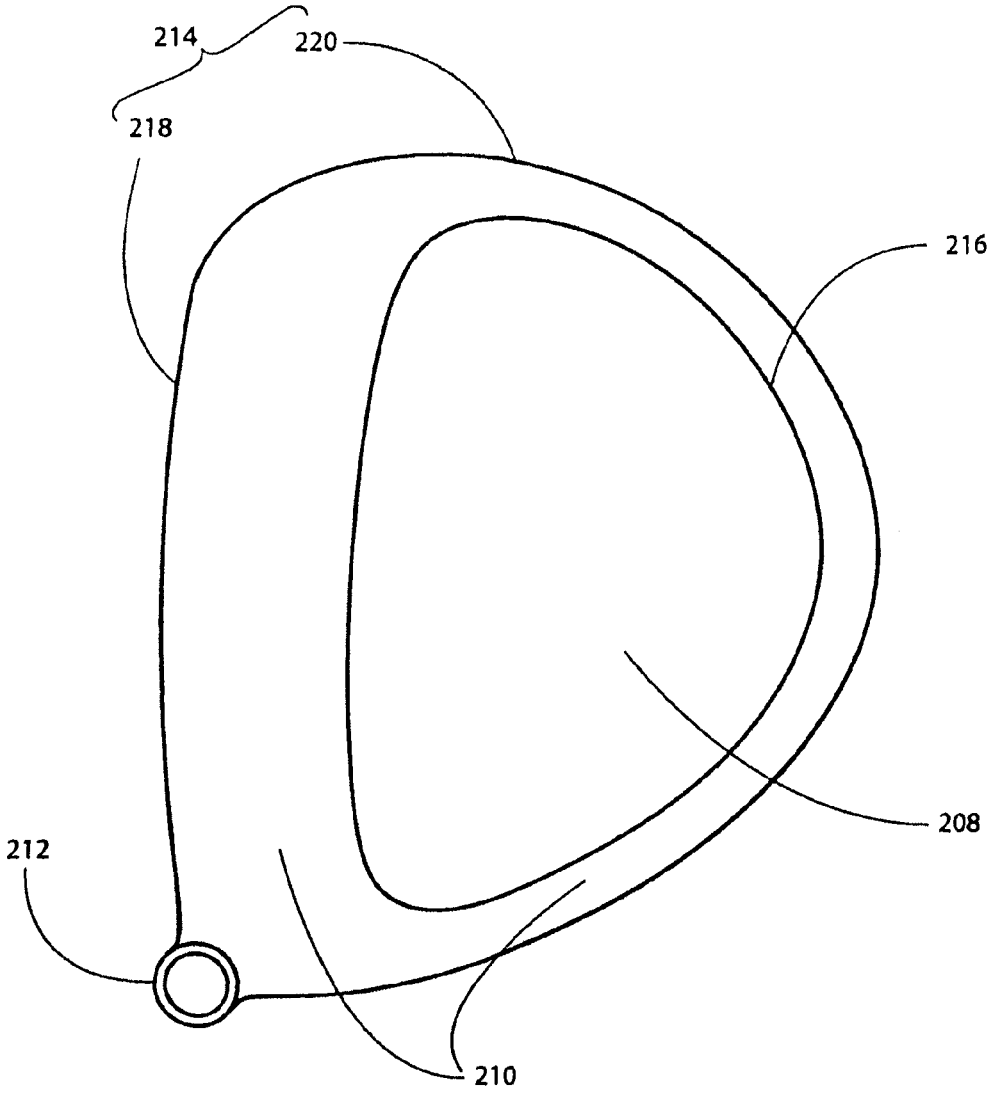
FIG. 2 is a view taken from the top and parallel to the face of the club head of FIG. 1.

Striking face portion 202 has a loft angle, which is the general angle striking face portion 202 forms relative to vertical when head 200 is resting in an address position. The extremities of crown 211 may be determined by viewing the club head from a top-down direction in a plane that is generally perpendicular to the loft angle, as illustrated in FIG. 2. The perimeter of the shape visible in this perspective, and represented by a crown perimeter edge 214, generally demarcates crown 211 from striking face portion 202 and skirt portion 206, both of which will not be visible from this perspective (see FIG. 1 instead). Crown perimeter edge 214 may comprise a top-line edge 218 that delimits crown 211 from face portion 202 and a tail edge 220 that delimits crown 211 from skirt portion 206. Minor crown portion 210 may have a surface contour generally consistent with contemporary metal wood crowns, and may be generally delimited from major crown portion 208 by a major crown portion perimeter edge 216. Either or both of edges 214 and 216 may not necessarily be represented by linear edges, but rather may be embodied as radiused or contoured transitions between the respective portions. In such instances, the line that passes through the approximate apex(es) along the radiused surface that joins said portions may be substituted for either or both of edges 214 and 216.

Major crown portion 208 may be generally characterized as being displaced vertically lower than the adjacent portions of minor crown portion 210. Major crown portion 208 may be further characterized as having a surface contour that does not follow the surface contour of minor crown portion 210, whereby the bulk of major crown portion 208 is displaced vertically downward relative to adjacent portions of minor crown portion 210. In one embodiment of the invention, major crown portion 208 may be characterized further still as having a concave surface contour while minor crown portion may be characterized as having a generally convex curvature, whereby the bulk of major crown portion 208 is displaced vertically downward relative to adjacent portions of minor crown portion 210. Alternatively, the contour of portion 208 may be generally planar. Thus, head 200 may maintain similar to identical sole and striking face proportions to modern metal wood heads with a reduction in volume of about 15 to about 40 percent, depending on the surface contour selected for major crown portion 208. Further, an appreciable amount of club head 200's minimum structural mass is relocated vertically lower, resulting in an improved center of gravity position at a decreased structural mass, thereby allowing for the possibility of improved launch conditions even before discretionary mass is added to attain a desired finished mass of between about 190 g and about 215 g for a driver type metalwood. Additionally, by lowering major crown portion 208 there is a significant reduction of skirt 206's surface area, and hence a corresponding reduction in material required to form the skirt, and therefore a corresponding increase in head 200's weight budget. The increased weight budget may be strategically distributed to further improve head 200's mass properties, or to construct additional performance-enhancing structural features.

Figure 5:
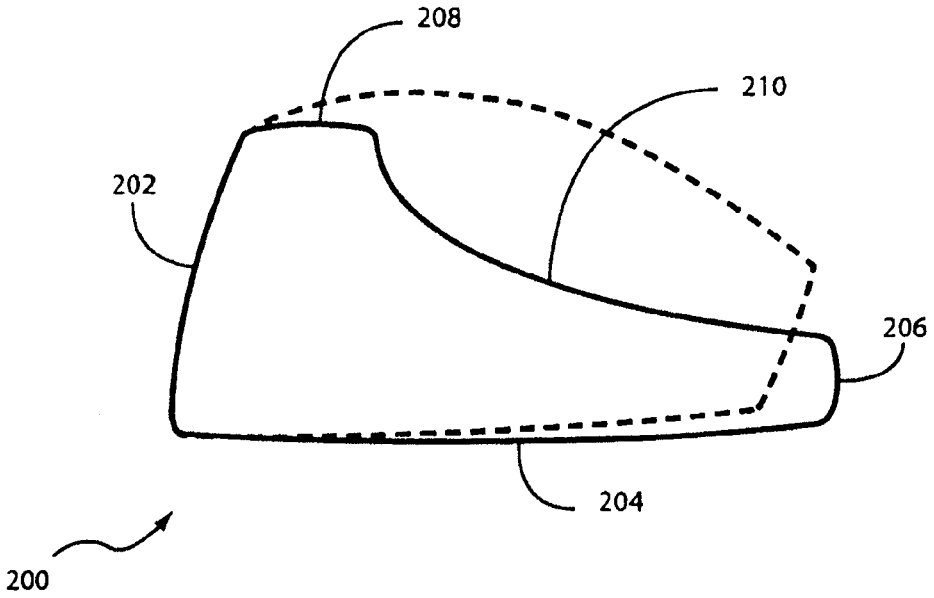
FIG. 5 is a silhouette of an embodiment of the golf club head in accordance with the present invention, overlaid with a silhouette of a known golf club head shown with phantom lines.
Figure 6:
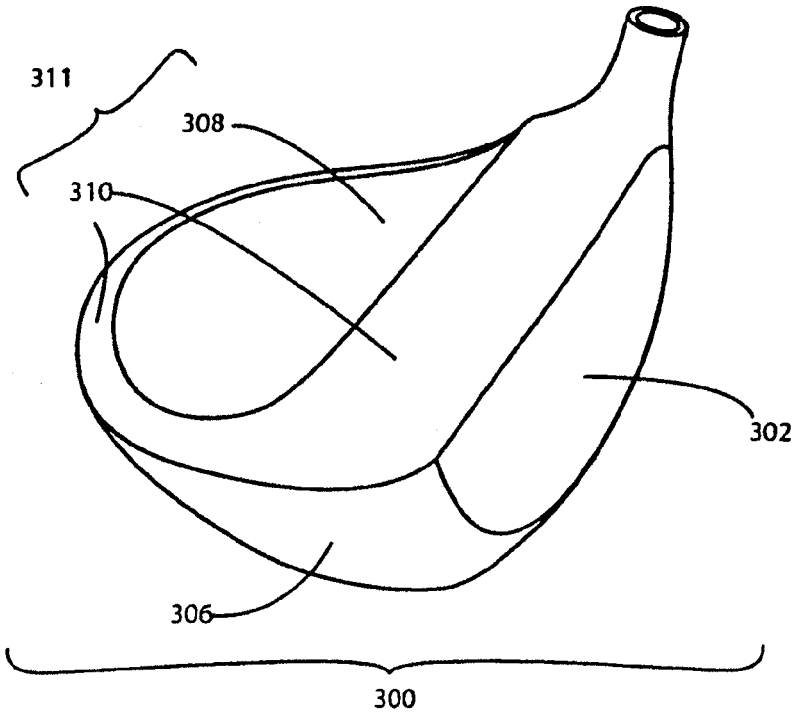
FIG. 6 is a perspective view of another embodiment of a club head according to the invention.
Figure 7:
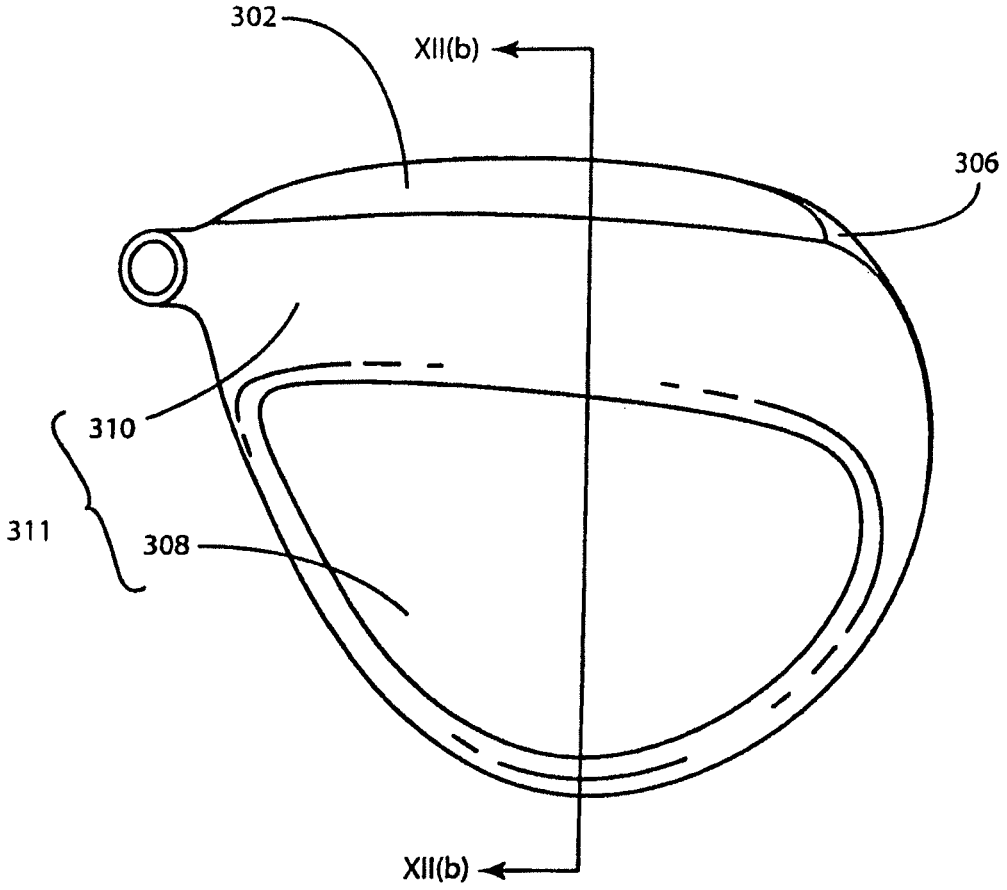
FIG. 7 is a top plan view of the golf club head of FIG. 6.
Figure 8:
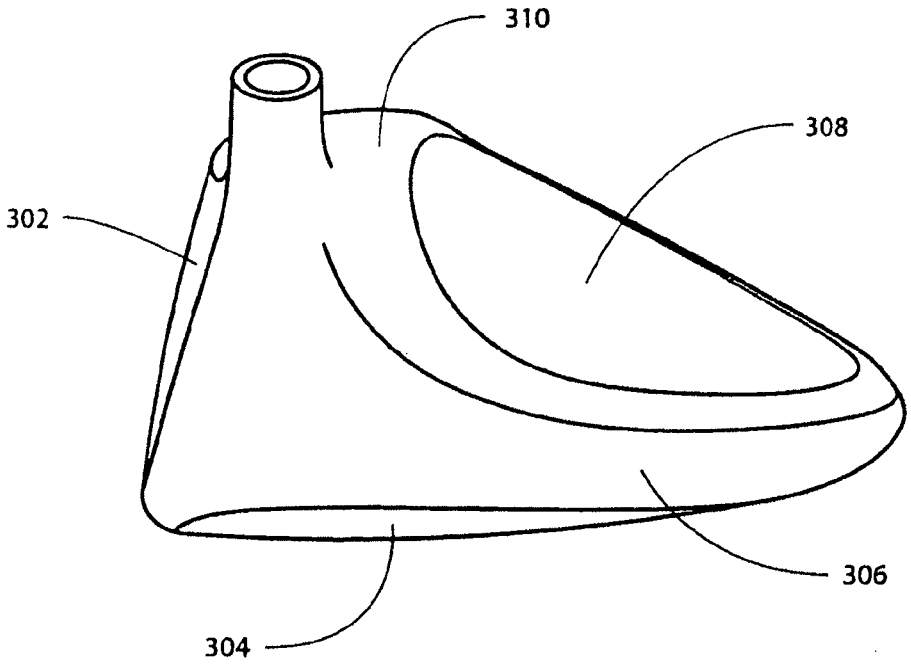
FIG. 8 is a heel view of the golf club head of FIG. 6.
Figure 9:
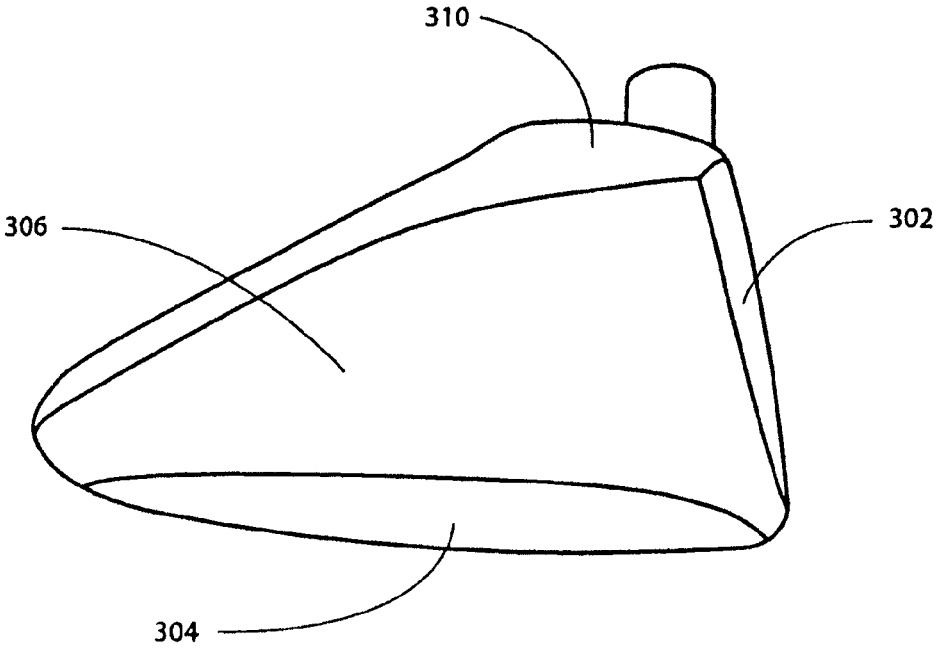
FIG. 9 is a toe view of the golf club head of FIG. 6.

FIG. 5 shows profiles of two club heads, each taken at a plane located generally at the center of each head. One is of a conventional metalwood club head shown in phantom lines, and the other is of head 200. As shown, in addition to features such as major crown portion 208 and minor crown portion 210, sole 204 may be generally flattened out towards the rear of the club head, generally lowering the junction between skirt 206 and the sole as compared to a conventional metalwood head. This further lowers the mass of the rear portion of the club head, particularly when discretionary mass is positioned on sole 204 proximate or adjacent to skirt 206 towards the rear of head 200. Sole 204 may further be enlarged, e.g. lengthened in the rearward direction, whereby discretionary mass placed on sole 204 towards the rear of head 200 may further improve the depth and height values of head 200's center of gravity, accompanied by an increase in moment of inertia.

Implementation of a recessed crown configuration alone may affect the inherent structural properties of head 200. For example, head 200 may achieve the USGA mandated maximum coefficient of restitution (COR) of 0.830 using a similar face thickness, or thickness profile for a variable thickness face, as would be used in a conventionally shaped metalwood head of similar proportions, yet may exhibit reduced overall structural stiffness when manufactured using a similar process, e.g. thin-wall cast body and welded-in-place face insert. While maintaining equivalent ball speeds as those generated by a conventionally shaped head having the same COR, this reduction in stiffness may, for example, present challenges to club head designers with respect to the acoustical response of the head during use since the sound radiated from head 200 at impact may be directly related to structural response.

Modal analyses were performed on a variety of finite element models representing exemplary configurations of head 200, each within the parameters of the numerous variables presented in the applicant's aforementioned patent application. By way of example, it was found that with similar overall dimensions, proportions and wall thicknesses as those of a conventionally shaped metalwood club head, head 200 may exhibit a reduction of between about 25% to about 50% in the primary modal frequency. These reductions in primary modal frequencies may be significant since the primary modal frequency may, for example, be viewed as the fundamental frequency of the audible response generated by head 200 at impact with a golf ball, and may alter the perceived quality of the sound produced at impact.

Generally, the effect that a particular mode will have on the overall sound quality of head 200 depends in part on the radiation efficiency of the mode. Radiation efficiency may be affected by several factors, for example the geometry of the structural area the mode occupies, the size of the structural area occupied by the mode, and the amplitude of oscillation of the mode. For example, since it may be difficult to predict the effect geometry may have on sound radiation efficiency, it may be possible to reduce the radiation efficiency of a particular mode by limiting the surface area of the mode, reducing the amplitude of oscillation of the mode, increasing the frequency of the mode, or a combination of any or all of the above.

Further, the acoustic performance of head 200 may vary inversely with the volume of the head. For example, it was found that when head 200 was configured to approximate the proportions of a 420 $cm^3$ driver type metalwood head, acoustic performance was deemed superior to that of a configuration which approximated the proportions of a 460 $cm^3$ driver type head. This may be due to the additional reduction in structural stiffness as a result of the increased surface area of the individual portions of head 200 in combination with the inherently less rigid geometry of the recessed crown configuration.

In one embodiment, head 200 was configured to have a volume of 340 $cm^3$, which corresponds to a conventional head displacing about 460 $cm^3$. A finite element analysis was performed on the head to determine the modal response at impact with a golf ball. The first, second and third modes were found to have frequencies of about 1960 Hz, 2460 Hz and 2920 Hz, respectively. All three modes were situated on the major crown portion. The first sole mode was found to be at approximately 3800 Hz. An example of a conventional head displacing about 460 $cm^3$ has first, second, and third modal frequency values of about 3940 Hz, 4010 Hz, and 4330 Hz, respectively, where the first and third modes are located on the crown and the second is located on the sole. Although head 200 exhibits improved launch conditions, and therefore greater carrying distance, in comparison to the exemplary conventional head, there is a significant reduction in the modal frequencies produced by impact. For many golfers, the sound of contemporary metalwood driver heads may be accepted and associated with good performance, therefore the difference in tones produced by head 200 may be unpleasant to some golfers and/or associated with poor performance, making acceptance of the club difficult.

FIGS. 6-9 show a head 300, which is similar in shape and geometry to head 200 and includes an internal structure that may be used to improve structural response. Head 300 may include a striking face portion 302, a sole portion 304 (see FIG. 8), a skirt portion 306, and a crown 311 comprising a major crown portion 308, and a minor crown portion 310. Head 300 is shown in cross section in FIG. 10(*a*), taken along line XII(b)-XII(b) of FIG. 7. A structural response modifying (SRM) element 400 is generally shown which comprises a constraining member 402 and a cantilever member 404.

Figure 10:
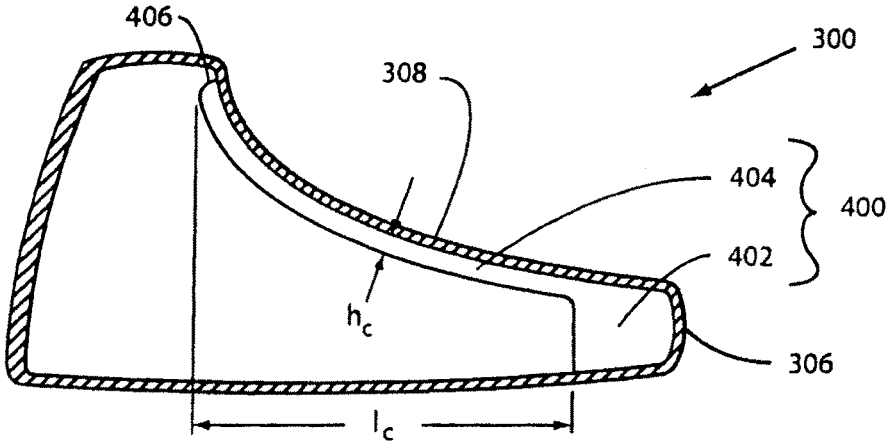
FIG. 10(*a*) is a cross-sectional view of the golf club head of FIG. 7 taken along line XII (b)-XII(b) showing a first embodiment of an internal feature of the golf club head according to the invention.
Figure 10:
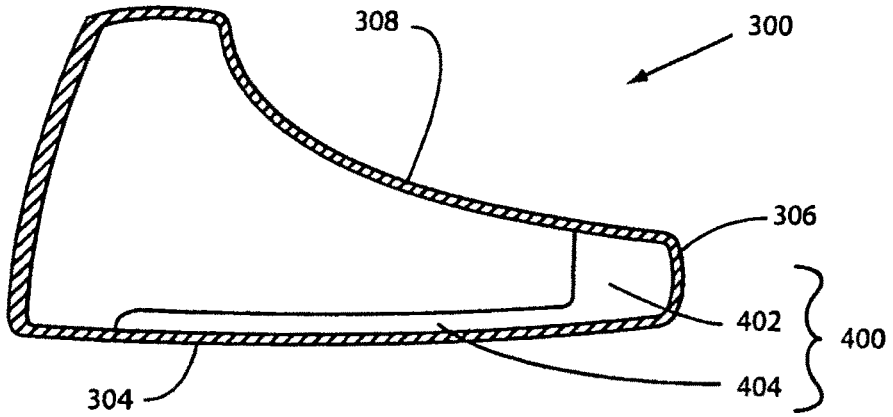
Figure 10:
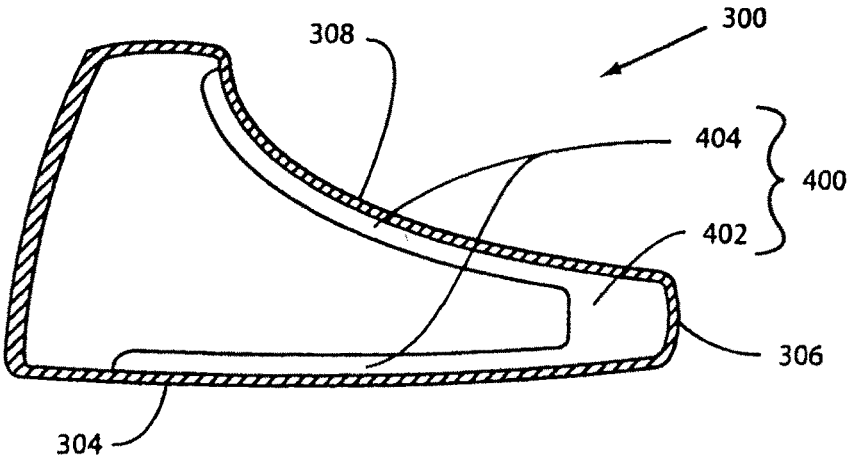
Figure 10:
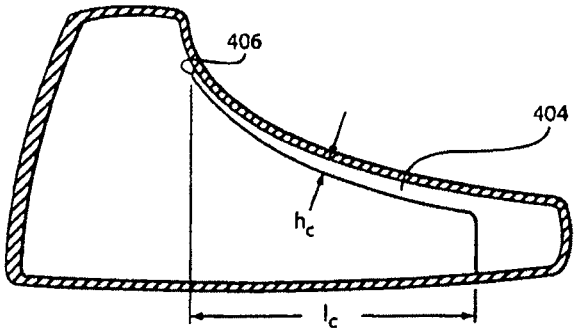
Figure 10:
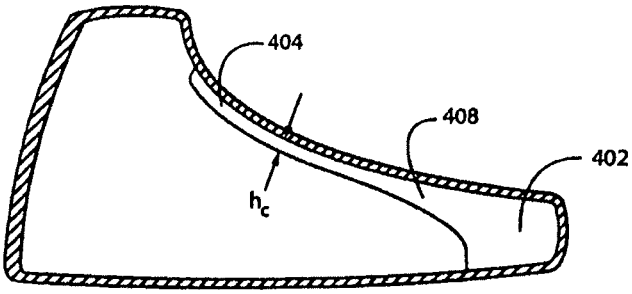
Figure 10:
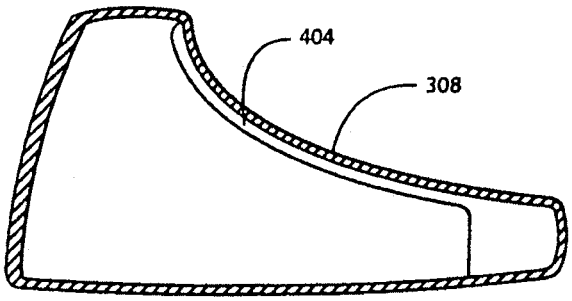
Figure 10:
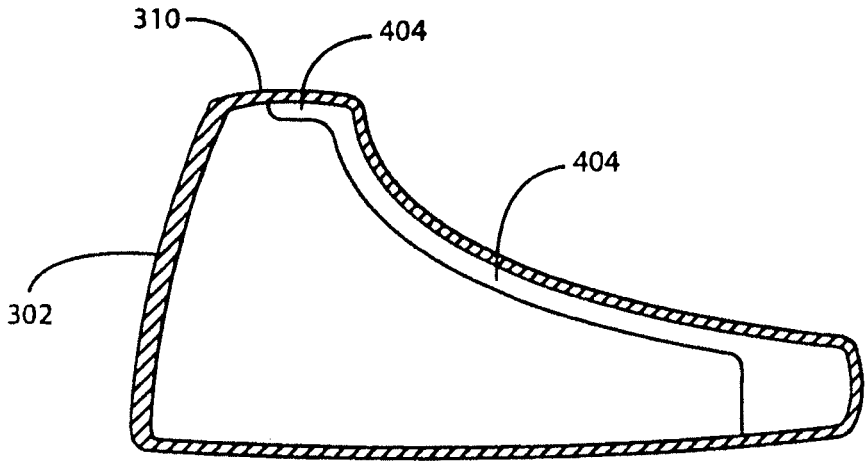
Figure 10:
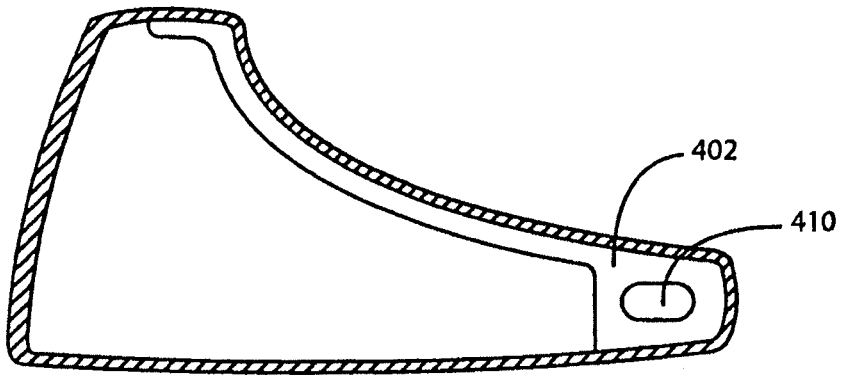

Constraining member 402 may generally constrain at least a portion of head 300 whose structural properties result in radiation of unwanted sound energy that detracts from head 300's acoustic performance, when used to impact a golf ball. For example, constraining member 402 may constrain major crown portion 308 to skirt portion 306 (not shown). Alternatively, constraining member 402 may constrain major crown portion 308 to sole portion 304 alone (not shown). In another example, constraining member 402 may constrain major crown portion 402 to both sole portion 304 and skirt portion 306, as shown in FIG. 10(*a*). Cantilever member 404 generally extends from constraining member 402 a distance, $l_c$, terminating at an end 406. At any point along $l_c$, the cantilever member may have a height, $h_c$, which may be measured substantially orthogonal to the inner surface of head 300, and which may generally have a value that is less than $l_c$.

In another embodiment, cantilever member 404 extends along sole 304, as shown in FIG. 10(*b*), whereas in yet another embodiment a cantilever member 404 extends along both sole 304 and major crown portion 308, as shown in FIG. 10(*c*).

Further, $h_c$ may vary along the length of the cantilever member 404, generally decreasing in value towards end 406, as shown in FIG. 10(*d*). Alternatively, cantilever member 404 may have at least a portion that has a constant $h_c$ value and at least a portion where $h_c$ varies. An example is shown in FIG. 10(*e*), where $h_c$ remains substantially constant from end 406 until reaching a transition region 408, which may smoothly transition cantilever member 404 to constraining member 402.

Generally, constraining member 402 may reduce the surface of major crown portion 308 that is effectively unconstrained, thereby reducing the area that may oscillate freely. Thus, constraining member 402 may decrease the area occupied by major crown portion 308's low frequency modes, and it may increase their frequencies, and may further reduce the amplitude of their oscillation. Cantilever member 404 may allow further tuning of the modal characteristics of major crown portion 308, for example by increasing the bending stiffness of the unconstrained area of the major crown portion, which may decrease the amplitude of oscillation and increase modal frequencies.

It may be particularly advantageous for cantilever member 404 to extend across the entire inner surface of major crown portion 308 as shown in FIG. 10(*f*). Additional benefit may be realized by allowing cantilever member 404 to extend some distance into minor crown portion 310 adjacent striking face 302, as shown in FIG. 10(*g*).

Constraining member 402 may be provided with at least one cut-out 410, an example of which is shown in FIG. 10(*h*). Cut-out 410 may provide weight-saving benefits without substantially reducing the structural integrity of the member.

Figure 11:
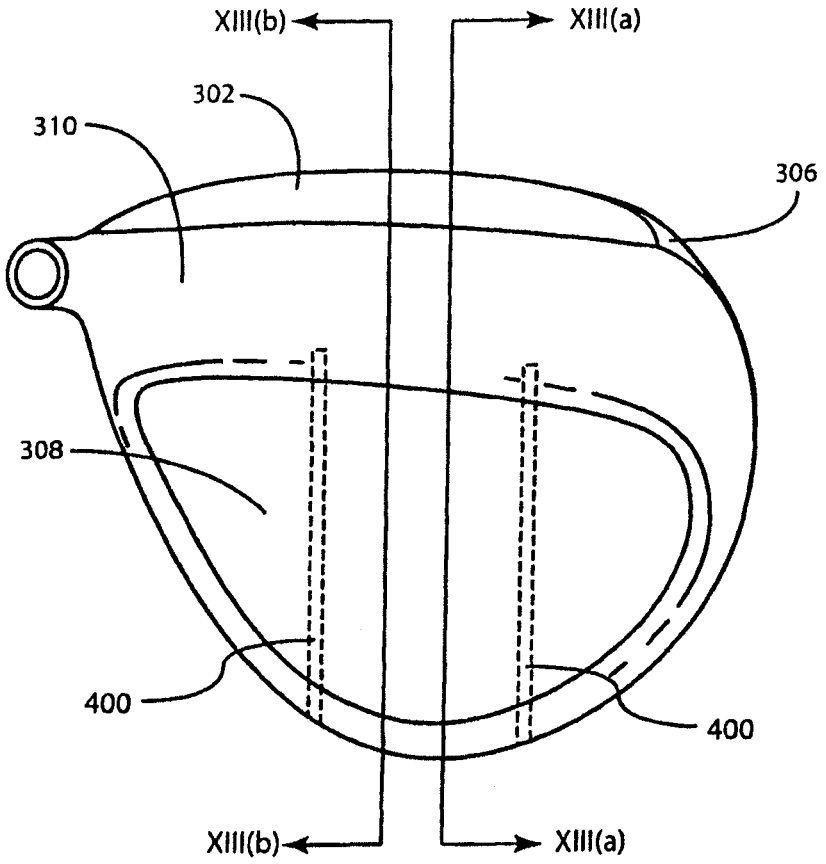
FIG. 11 is a top plan view of the golf club head of FIG. 6, showing internal features of the golf club head with hidden lines.

Typical $h_c$ values may range from between about 1 mm and about 10 mm. For heads having proportions similar to modern driver type club heads, e.g., about 300 to about 550 $cm^3$, it may be advantageous to provide more than one structural modifying element. FIG. 11 shows head 300 in plan view and provided with two SRM elements 400, shown with hidden lines. In this embodiment, $h_c$ may be between about 1.5 mm and about 4 mm. Most preferably, height $h_c$ may be between about 2 mm and about 3.5 mm. Although elements 400 are shown as positioned generally perpendicular to face portion 302 and parallel to each other, it should be appreciated that they may be oriented at a variety of angles relative to both face portion 302 and each other, and still achieve the desired result.

Figure 12:
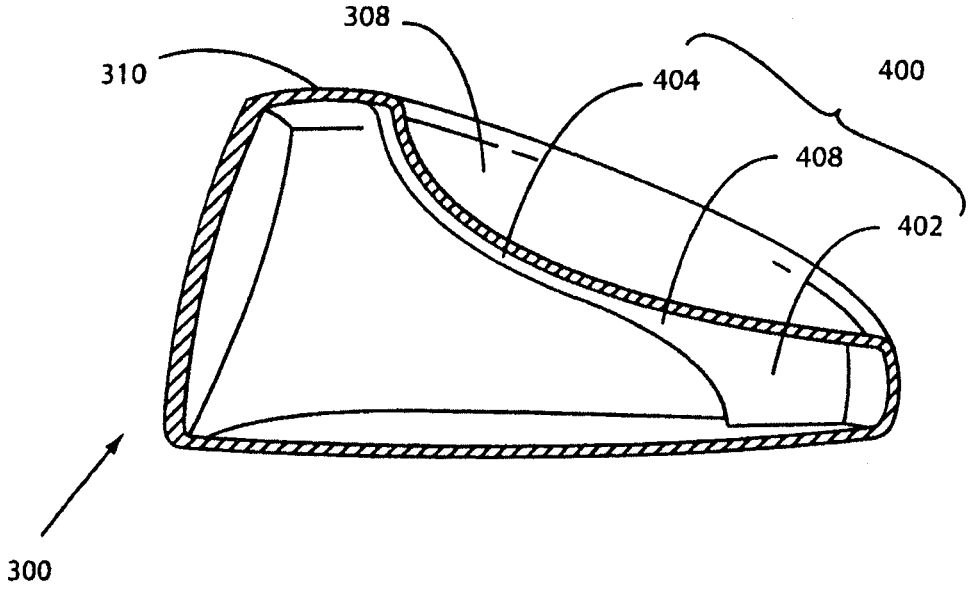
FIG. 12(*a*) is a cross-sectional view of the golf club head of FIG. 11 taken along line XIII(a)-XIII(a).
Figure 12:
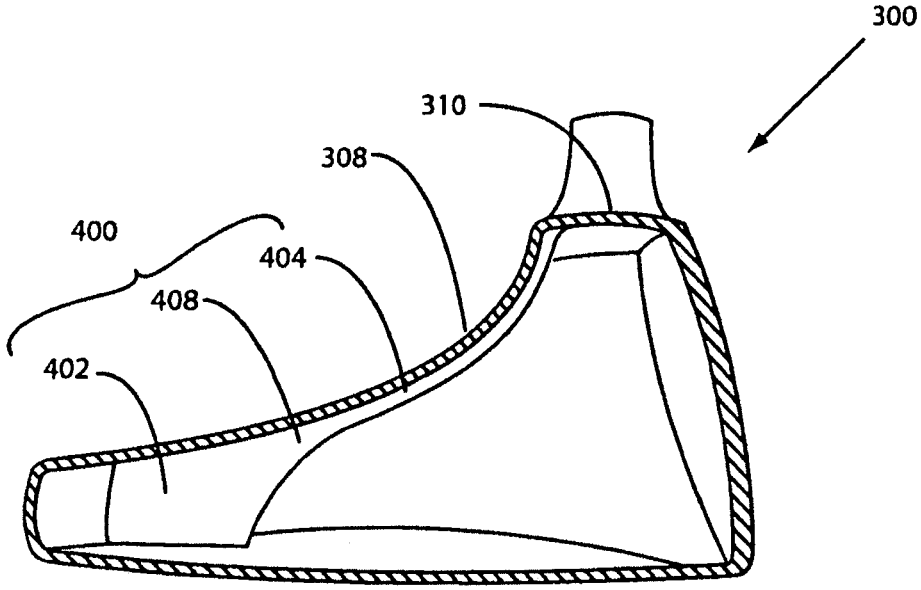

In another example, for a head approximating the proportions of a typical fairway wood sized head, e.g. 100-190 $cm^3$, it may be advantageous to use a single element 400, where height $h_c$ may range from about 2 mm to about 10 mm, and more preferably from about 3 mm to about 6 mm. A finite element simulation was performed on head 300 provided with two SRM elements 400 positioned as shown in FIG. 11. For the simulation, both elements 400 were a combination of the types of FIGS. 10(*g*) and (*e*), as shown in FIGS. 12(*a*) and (*b*). Cantilever member 404 extends into minor crown portion 310, transitioning smoothly into constraining member 402 over transition region 408. The simulation showed that the addition of elements 400 increased the frequency of the first three modes, located on major crown portion 308, to about 2815 Hz, 3270 Hz, and about 3700 Hz, or about 44%, 33%, and 27%, respectively, in comparison with the first three modes of head 200. This reduction in modal frequencies results in a more pleasing sound at impact, and is complemented by an overall reduction in radiation efficiency of the low frequency modes. This results in the first sole mode being more audible at impact, dominating the acoustic response and delivering a pleasing sound to the end user of the head.

Figure 13:
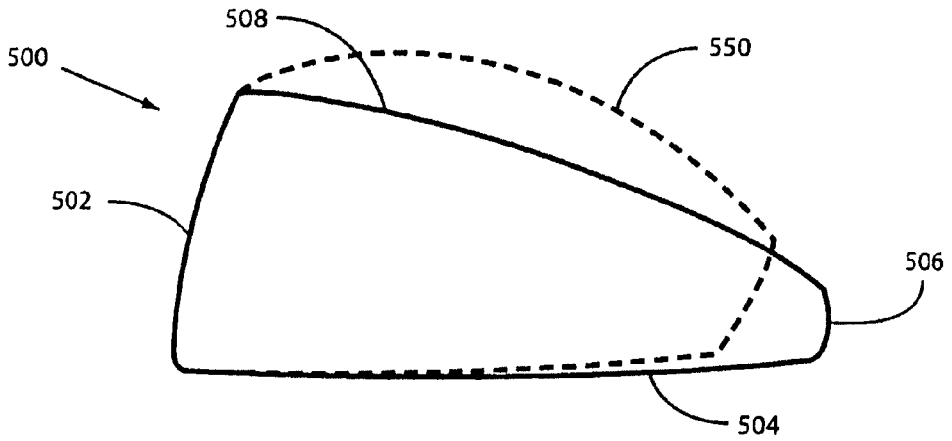
FIG. 13 is a silhouette of an embodiment of a golf club head in accordance with the present invention overlaid with a silhouette of a known golf club head shown in phantom lines.

Although the benefits of implementing an SRM element comprising a constraining member and a cantilever member have been demonstrated for a head having a displaced crown configuration, it should be appreciated that the application of the element may not be limited solely to this head configuration. Similar needs for increased structural stiffness may be necessary for a variety of other head configurations. For example, as shown in FIG. 13, a head 500 is shown having a face portion 502, a sole portion 504, a skirt portion 506, and a crown portion 508. Head 500 has increased face to tail dimensions relative to a conventionally shaped metalwood head 550, shown in phantom lines. The volumetric displacement of head 500 may not necessarily be substantially greater than that of head 550, however, the surface area of crown portion 508 and/or sole portion 504 may be increased. When the thicknesses of these portions are kept to a minimum, crown portion 508 and/or sole portion 504 may be inherently less rigid than corresponding portions of head 550. This may result in decreased modal frequencies in either crown portion 508, or sole portion 504, or both.

Figure 14:
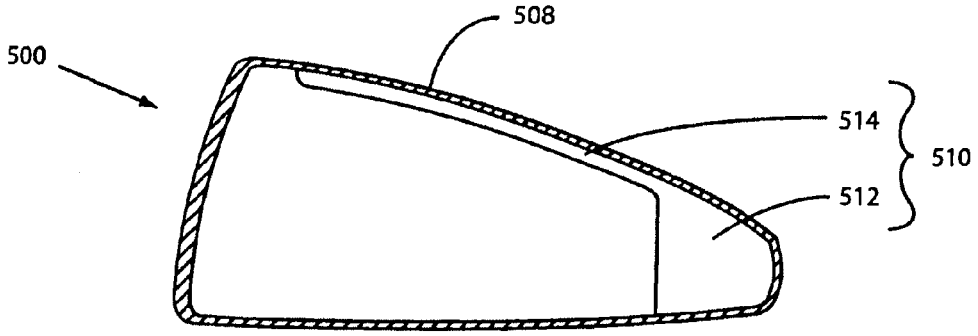
FIG. 14(*a*) is cross-sectional view of the golf club head of FIG. 13 showing a first embodiment of an internal feature of the golf club head according to the invention.
Figure 14:
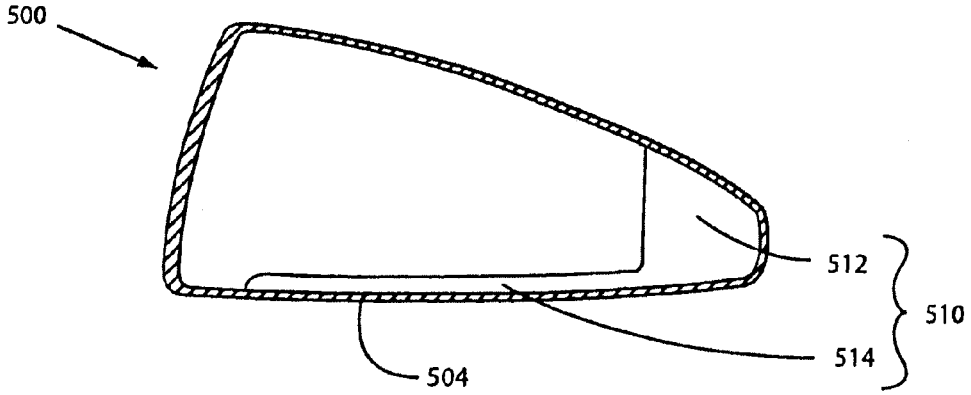
Figure 14:
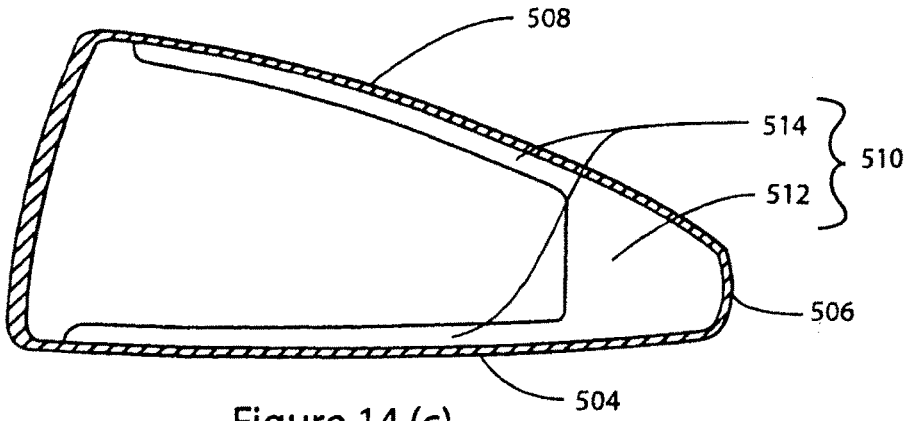
Figure 14:
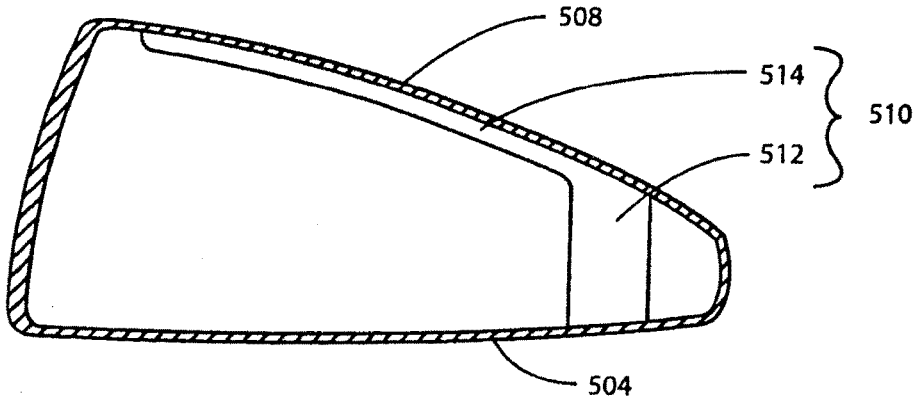
Figure 14:
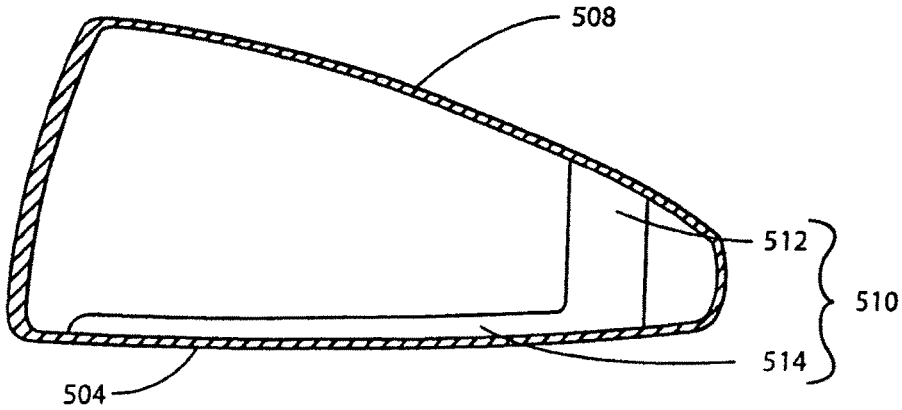
Figure 14:
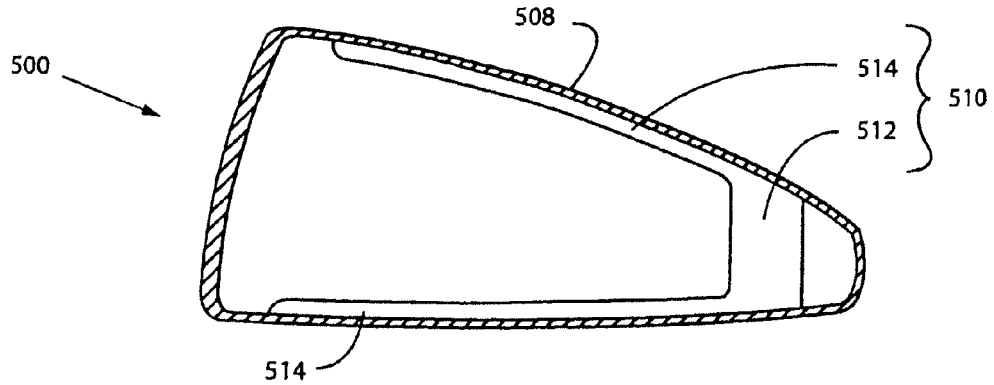
Figure 14:
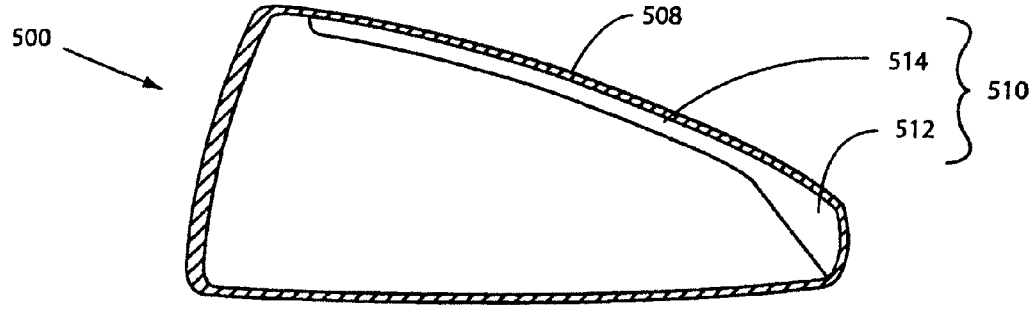
Figure 14:
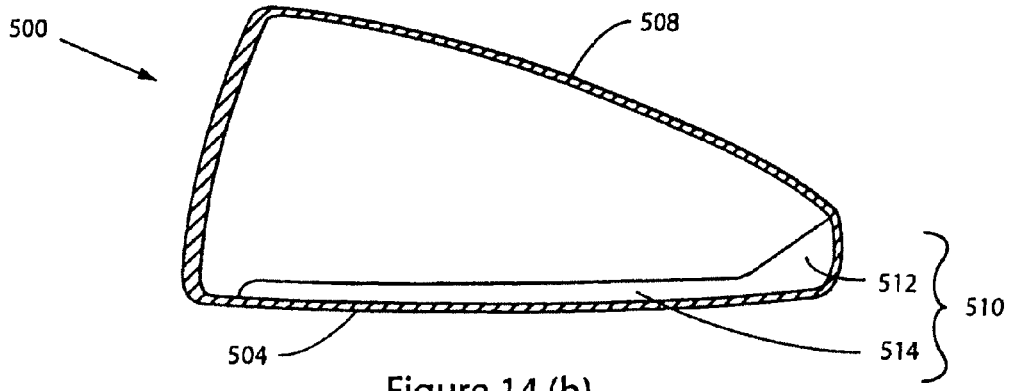

FIGS. 14(*a*)-(*c*) show three embodiments of a structural response modifying element 510 having a constraining member 512 and at least one cantilever member 514 that may be adapted to head 500. FIG. 14(*a*) demonstrates cantilever member 514 providing stiffness to crown 508. FIG. 14(*b*) shows cantilever member 514 providing added stiffness to sole portion 504. FIG. 14(*c*) demonstrates two cantilever members 514 providing stiffness to both crown portion 508 and sole portion 504. In all the examples, constraining member 512 may optionally include at least one cutout (not shown), for weight savings. Further, although constraining member 512 has been shown as being fixed to crown 508, skirt 506 and sole 504, sufficient improvements to the structural response of head 500 may be achieved by constraining the crown to the sole alone, as shown for example in FIGS. 14(*d*)-(*f*). Further possibilities include using constraining member 512 to constrain either of crown 508 or sole 504 to skirt 506 alone, as shown in FIGS. 14(*g*) and (*h*), while providing additional stiffness with cantilever member 514. In all embodiments, a single structural response modifying element 510 may sufficiently improve the structural response of head 500. However, it is possible that a plurality of elements 510 may be required, for example, two, three, or more, depending on the size and geometry of the head.

Figure 15:
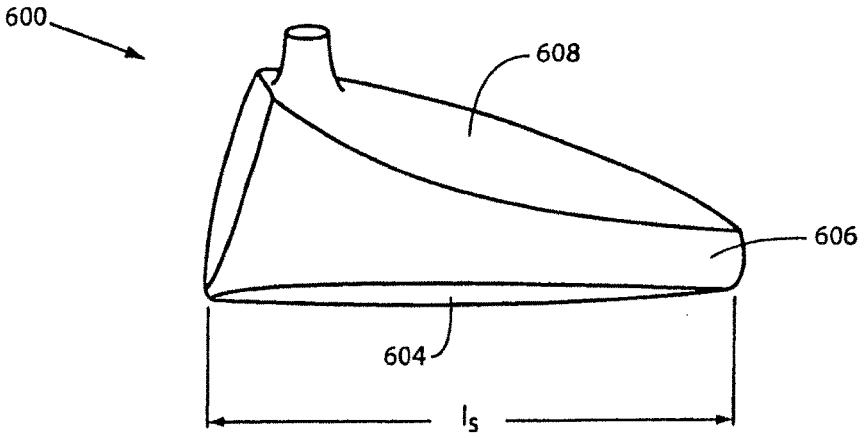
FIG. 15 is a heel view of a golf club head in accordance with the present invention.
Figure 15:
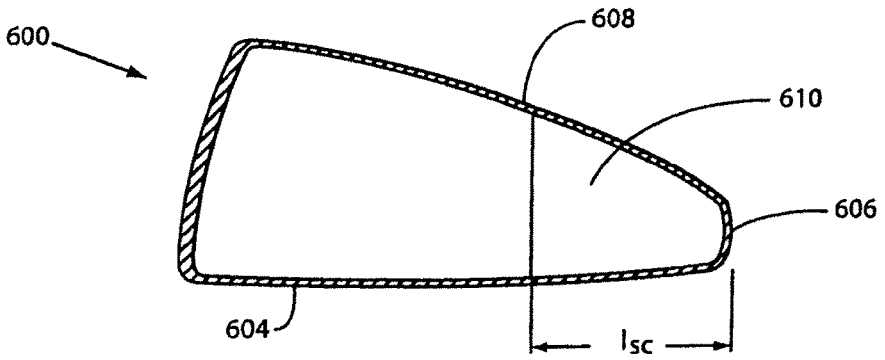
Figure 15:
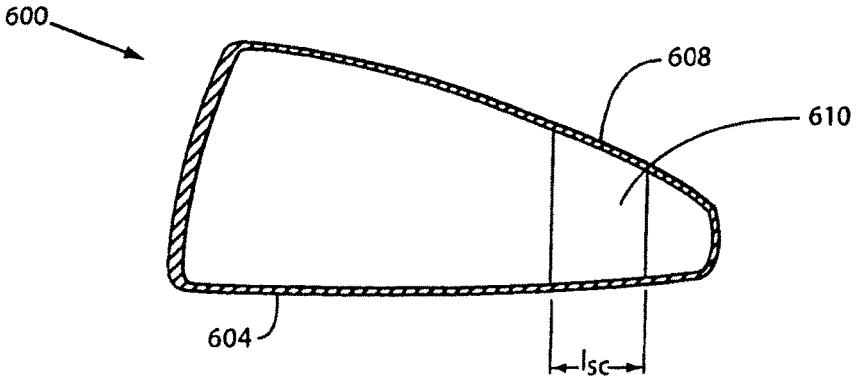

In some instances, sufficient reductions in radiation efficiency of low frequency modes may be obtained by providing metalwood heads with constraining members alone. Typically, in such instances a metalwood head 600, as shown in FIG. 15, may have a maximum sole length $l_s$ greater than about 3.5 inches, measured with the club head in an address position. As $l_s$ is increased beyond 3.5 inches, modes may be present on a sole 604 or a crown 608 which detract from the overall acoustic performance of head 600. The introduction of a constraining member 610 (shown in FIGS. 15(*a*) and (*b*)) having a sole contact length $l_{sc}$ may effectively modify modes generating poor acoustic signals, for example by increasing their frequency, reducing their amplitude of oscillation, and by limiting the unconstrained surface area of sole 604 and/or crown 608. Maintaining the forward portion of metalwood head 600 free of constraining members allows the front structure of the head to deform freely, which benefits the energy transfer from head 600 to a ball (not shown) during impact, and allows favorable modes to dominate the acoustic signal. FIG. 15(*a*) shows a cross section of head 600 revealing a constraining member 610 that constrains crown 608 and sole 604 to skirt 606. FIG. 15(*b*) shows constraining member 610 configured to constrain crown 606 and sole 604 alone. It should be appreciated that, as in previous examples, constraining member 610 may be used to constrain either of sole 604 or crown 608 to skirt 606 alone (not shown). As with all other constraining members discussed herein, constraining member 610 may contain a cut-out (not shown).

Generally, an improved acoustic response may be achieved by limiting $l_{sc}$ to no more than 40% of $l_s$ and more preferably to between 10-40% of $l_s$. In another aspect of the invention, it may be preferable to limit $l_{sc}$ to no more than 35% of $l_s$. Furthermore, constraining member 610 may provide improvements to the acoustic response of head 600 when the $l_s$ value is greater than or equal to about 3.75 inches.

Further techniques which may be used to modify or enhance the structural response of a hollow metalwood head that has poor acoustic performance include localized thickening of a portion of the head in a region of high modal stress. The region of high modal stress to be thickened should be in the area occupied by the mode or modes which are affecting the acoustic performance of the head. Modal stress refers to the relative stress caused in a given portion of the head by modal oscillations. The greater the amplitude of oscillation, the higher the modal stress. Generally, the maximum stress induced by the low frequency modes may not be so high as to require thickening of the affected portion for structural reasons. In most cases, the actual stress values attributed to the displacement of the mode may be a small fraction of the failure strength of materials commonly used to produce hollow metalwood clubs, such as steel alloys, titanium alloys, composites, aluminum alloys, plastics, and the like. However, it was found that by thickening the head portion in the highest modal stress area of a particular mode, the modal frequency could be improved, or increased, about 100 to about 350 Hz in general, and in some cases even more. Additionally, the mode's amplitude was decreased and the overall radiation efficiency of the mode also reduced. Thus, thickening of high modal stress areas of portions containing low frequency modes which detract from the acoustic performance of any of the aforementioned heads may effectively be used to improve overall acoustic quality of said heads. Typical thickness increases that will prove effective may generally be about 20% to about 100% of the portion thickness, depending on the material being used and the modal stress values.

Similarly, when a low frequency mode which detracts from a given hollow metalwood head's acoustic performance is present proximate the junction of two or more portions of that head, a constraining member may be used to tie the portions together. This may be effective when the constraining member is allowed to pass through the region of highest modal stress, thereby effectively reducing the amplitude of oscillation of the mode, increasing the mode's frequency, and generally reducing the mode's radiation efficiency.

It should be appreciated that the structural response modifying elements disclosed herein may be formed integrally along with the various portions of a particular head, for example by casting, or may be manufactured separately and affixed within the head, for example by welding, adhesive bonding, mechanical fastening or any suitable joining technique. When manufactured separately from the head, it may be beneficial to use materials that provide weight and/or cost savings for their construction. As examples, plastics, fiber reinforced plastics, or low density metals such as aluminum and magnesium alloys may be used to form the elements.

The above-described embodiments of the club head are given only as examples. Therefore, the scope of the invention should be determined not by the illustrations given, but by the appended claims and their equivalents.

The invention claimed is:

1. A hollow-type golf club head comprising:
a face end and a tail end;
a strike face at the face end;
a crown;
a sole; and
a structural response modifying element comprising,
a constraining member having a first end and a second end that is forward of the first end and spaced from the strike face, the constraining member extending vertically to contact the sole and the crown at locations including the first end and the second end, and extending horizontally by a first maximum distance that is at least 10% of the sole length, when the club head is oriented in an address position; and
a cantilever member extending from the constraining member toward the strike face, the cantilever member located on the sole for stiffening the sole forward of the constraining member.

2. The golf club head of claim 1, further configured to exhibit a dominant resonant frequency greater than 3000 Hz.

3. The golf club head of claim 2, wherein the dominant resonant frequency is greater than about 3500 Hz.

4. The golf club head of claim 2, wherein the dominant resonant frequency is between 3500 Hz and about 4000 Hz.

5. The golf club head of claim 1, wherein the crown is capable of generating the dominant resonant frequency.

6. The golf club head of claim 1, wherein the sole is capable of generating the dominant resonant frequency.

7. The golf club head of claim 1, wherein the sole length is greater than 3.75 inches.

8. The golf club head of claim 1, further comprising a skirt, wherein the first end is spaced from the skirt.

9. The golf club head of claim 1, wherein the cantilever member extends horizontally a second maximum distance that is greater than the first maximum distance.

10. The golf club head of claim 1, wherein the cantilever member comprises a cantilever height between about 1 mm and about 10 mm.

11. The golf club head of claim 10, wherein the cantilever height is between about 1.5 mm and about 4.5 mm.

12. The golf club head of claim 1, wherein the crown is capable of generating the dominant resonant frequency.

13. The golf club head of claim 1, wherein the cantilever portion is on the crown for stiffening the crown forward of the constraining member.

14. The golf club head of claim 13, wherein the structural response modifying element further comprises a second cantilever member extending from the constraining member toward the strike face and located on the sole for stiffening the sole forward of the constraining member.

15. The golf club head of claim 1, wherein the sole is capable of generating the dominant resonant frequency.

16. The golf club head of claim 1, wherein the sole has a length greater than 3.5 inches.

17. The golf club head of claim 1, having a volume greater than 300 $cm^3$.

18. A hollow-type golf club head comprising:
a face end and a tail end;
a strike face at the face end;
a crown;
a sole; and
a structural response modifying element comprising,
a constraining member having a first end and a second end that is forward of the first end and spaced from the strike face, the constraining member extending vertically to contact the sole and the crown at locations including the first end and the second end, and extending horizontally by a first maximum distance that is not more than 40% of the sole length, when the club head is oriented in an address position, and
a cantilever member extending from the constraining member toward the strike face, the cantilever member located on the sole for stiffening the sole forward of the constraining member.

19. The golf club head of claim 18, further configured to exhibit a dominant resonant frequency greater than 3000 Hz.

20. The golf club head of claim 19, wherein the dominant resonant frequency is greater than about 3500 Hz.

21. The golf club head of claim 19, wherein the dominant resonant frequency is between about 3500 Hz and about 4000 Hz.

22. The golf club head of claim 18, wherein the crown is capable of generating the dominant resonant frequency.

23. The golf club head of claim 18, wherein the sole is capable of generating the dominant resonant frequency.

24. The golf club head of claim 18, wherein the sole length is greater than 3.75 inches.

25. The golf club head of claim 18, further comprising a skirt, wherein the first end is spaced from the skirt.

26. The golf club head of claim 18, wherein the cantilever member extends horizontally a second maximum distance that is greater than the first maximum distance.

27. The golf club head of claim 18, wherein the cantilever member comprises a cantilever height between about 1 mm and 10 mm.

28. The golf club head of claim 18, wherein the cantilever height is between about 1.5 mm and about 4.5 mm.

29. The golf club head of claim 18, wherein the crown is capable of generating the dominant resonant frequency.

30. The golf club head of claim 18, wherein the cantilever portion is on the crown, for stiffening the crown forward of the constraining member.

31. The golf club head of claim 30, wherein the structural response modifying element further comprises a second cantilever member extending from the constraining member toward the strike face and located on the sole for stiffening the sole forward of the constraining member.

32. The golf club head of claim 18, wherein the sole is capable of generating the dominant resonant frequency.

33. The golf club head of claim 18, wherein the sole has a length greater than 3.5 inches.

34. The golf club head of claim 18, having a volume greater than 300 $cm^3$.

* * * * *